United States Patent [19]

Kirschner

[11] 3,938,468

[45] Feb. 17, 1976

[54] APPARATUS FOR WIPING LIQUID FROM A STRIP

[75] Inventor: James B. Kirschner, Moundsville, W. Va.

[73] Assignee: Wheeling-Pittsburgh Steel Corporation, Pittsburgh, Pa.

[22] Filed: Apr. 29, 1970

[21] Appl. No.: 32,826

[52] U.S. Cl. ..... 118/63; 15/419; 15/420; 34/160; 239/569; 239/592; 239/597; 427/273; 427/287; 427/347; 427/348; 427/433; 427/434; 427/436

[51] Int. Cl.[2] ..... B05C 11/00; B05C 13/00; B05C 13/02

[58] Field of Search..... 117/102 M, 102 L, 114 R, 117/114 A, 114 B, 114 C, 102 R; 118/63; 15/306 A, 307, 308, 415, 418, 419, 420; 134/64, 122; 239/569, 589, 564, 590, 592, 594; 34/160, 155, 152

[56] References Cited

UNITED STATES PATENTS

| | | | |
|---|---|---|---|
| 811,854 | 2/1906 | Lee | 117/102 M |
| 1,302,227 | 4/1919 | Schlatter et al. | 239/564 |
| 1,715,140 | 5/1929 | Martin | 239/597 |
| 2,135,406 | 11/1938 | MacDonald | 117/102 L X |
| 2,237,727 | 4/1941 | Ross | 15/373 |
| 2,534,189 | 12/1950 | Wright | 15/415 |
| 3,002,700 | 10/1961 | Möhring | 239/592 X |
| 3,145,409 | 8/1964 | Davey et al. | 15/306.1 |
| 3,314,163 | 8/1967 | Kohler | 239/594 |
| 3,499,418 | 3/1970 | Mayhew | 118/4 |
| 3,526,204 | 9/1970 | Schendler et al. | 118/8 |

FOREIGN PATENTS OR APPLICATIONS

| | | | |
|---|---|---|---|
| 628,621 | 9/1949 | United Kingdom | 239/590 |
| 714,915 | 9/1968 | Belgium | 117/102 M |

*Primary Examiner*—William A. Powell
*Assistant Examiner*—Brian J. Leitten
*Attorney, Agent, or Firm*—Buell, Blenko & Ziesenheim

[57] ABSTRACT

This application discloses "wiping" of a liquid, molten zinc, for example, across the surface of a strip to which it adheres. A wiping fluid, such as steam, is directed from an orifice at the strip. A valve, preferably an elongated relieved bar is positioned adjacent and behind the orifice, and flow of wiping fluid is controlled by rotation of an elongated valve in the form of a relieved bar or cam.

6 Claims, 5 Drawing Figures

INVENTOR
James B. Kirschner
By Buell, Blenko & Ziesenheim
his attorneys

APPARATUS FOR WIPING LIQUID FROM A STRIP

In the manufacture of steel mill products, it is common to coat a substrate such as a strip with another substance by dripping. A common example is the manufacture of galvanized sheets in which a steel strip may be passed through a bath of molten zinc by which the zinc is adhered to the strip. Thereafter the strip is cut into sheets.

In such processes, the liquid adhered to the substrate may not be uniformly distributed. As the liquid freezes on the strip a coating of variable thickness will be developed across the substrate.

I have invented new and useful improvements in wiping liquid from a moving strip which avoids problems previously encountered and produces a better product having a more even coating. I provide an enclosure extending transversely of the strip and past which the strip is moved. I provide orifice means in the enclosure directed toward the strip. Preferably said orifice means are in the form of an elongated slot extending over at least a substantial width of the strip. I further provide means to supply a wiping fluid to the enclosure under pressure. Said wiping fluid may, for example, be steam supplied from a plant steam line. I further provide valve means associated with said orifice and adjustable to selectively vary the flow of wiping fluid through the orifice means. Preferably said valve means are selectively variable along the length of said orifice whereby the flow of wiping fluid may be adjusted to issue from the orifice means with varying intensities at different points across the width of the strip. I further prefer that said valve means comprise elongated rotatable cam means.

Other details, objects and advantages of my invention will become apparent as the following description of the present preferred embodiment thereof proceeds.

In the accompanying drawings I have illustrated a present preferred embodiment of the invention in which FIG. 1 is a diagrammatic plan view of a strip between two wiping means;

A known method of galvanizing is by drawing strip through a galvanizing pot, thereby establishing a continuous hot dip process. The zinc which is deposited freezes as the strip is withdrawn and thereby forms the well-known galvanized material suitable for cutting into sheets and other or further fabrication.

In withdrawing the strip from the molten zinc the thickness of liquid zinc adhering to the strip often varies across the width of the strip. For example, the surface conditions at the edges are different than at the center where there is an extending surface in each direction. The conditions at the edge may cause a substantially heavier coating at the edges than at the center thus causing a nonuniform product.

Figure 1:
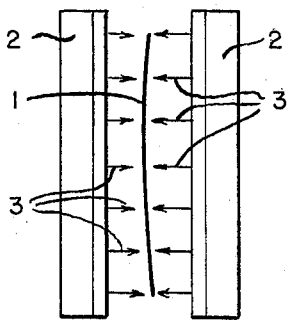
Figure 2:
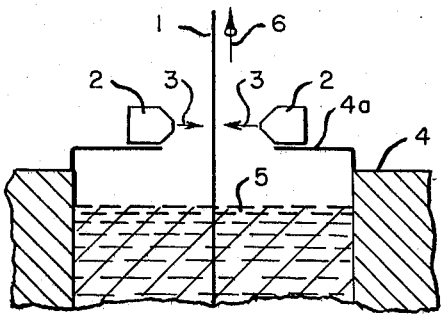
FIG. 2 is a side elevation, also diagrammatic of the apparatus shown in FIG. 1.

In FIG. 1, strip 1 is shown being drawn upwardly toward the viewer from a zinc pot beneath. An enclosure is shown on each side of the strip. A wiping fluid such as steam issues from an extended orifice on each enclosure. The flow of steam directed toward the strip is shown by arrows 3. A side view is shown in FIG. 2. The galvanizing pot 4, which may be an induction heated furnace, contains molten zinc to a level 5. The strip is drawn upwardly from the pot in the direction shown by arrow 6. The pot may be shrouded by a cover 4*a*. Enclosures 2 may be moved toward or away from the strip upon their supports.

Figure 3:
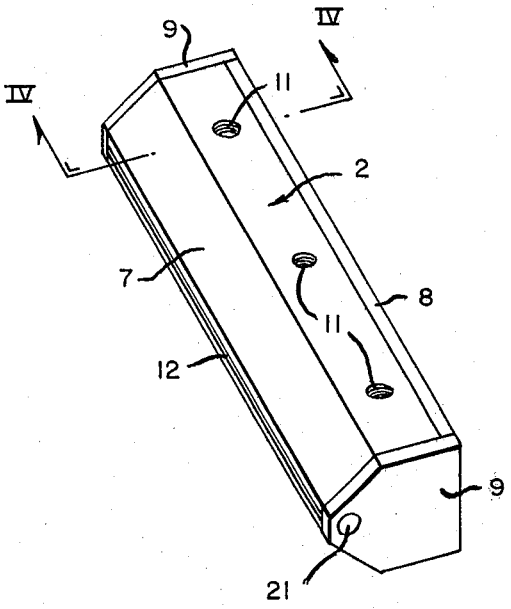
FIG. 3 is a perspective view of one wiping apparatus as used in FIGS. 1 and 2.
Figure 4:
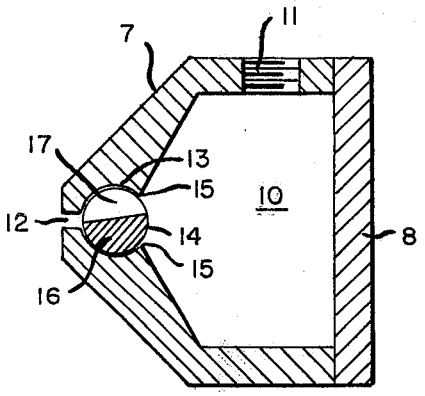
FIG. 4 is an end sectional view of the apparatus shown in FIG. 3 taken along line IV—IV.

One of enclosures 2 is shown in FIGS. 3 and 4. Each enclosure includes a main housing 7 which may be in one or several sections. A back wall 8 and end walls 9 cooperate with main housing 7 to form an enclosed space 10. A series of steam inlet ports 11 are drilled in the upper surface of enclosure 7 and are connected through flexible tubing to a plant steam line. An orifice 12 is formed in the side of housing 7 adjacent the strip. Orifice 12 is in the form of an elongated slot which extends from one end to the other of housing 7. If desired the slot can be of constant dimension, or it can be of varying size from point to point along its length. A circular bore 13 is formed in enclosure 7 behind orifice 12, and between the orifice and enclosed space 10. A round bar 14 is fitted in the bore and is revolvable in it. Lips 15 which form a part of the wall surrounding the bore are closer together than the diameter of bar 14 and prevent it from rolling into enclosed space 10.

Bar 14 is a rotary valve member whose rotation has a valve action to open and close a path between enclosed space 10 and orifice 12. It will be seen that in the sections of FIG. 4, the lower portion 16 is solid whereas the upper portion 17 has been cut away. In the positions shown there is a path for steam flow from enclosed space 10 around the solid portion 16 and through the relieved upper area through orifice 12. Rotation of bar 14 will however, cause the area for steam flow to be reduced and then cut off if rotation continues.

Figure 5:
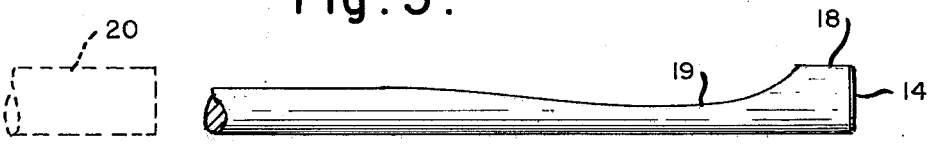
FIG. 5 is a partial side elevational view of a valve cam employed in the apparatus of FIG. 4.

The amount of solid bar 16 and the area 17 where the bar has been cut away may be varied to fit the circumstances. Moreover, the amount cut away may be selectively varied along the length of the bar. In that manner the steam flow may be different at different points along the length of orifice 12. Furthermore rotation of bar 14 may variably restrict and control the steam flow at varying points. FIG. 5 shows a side view of one portion of bar 14. An outer end 18 is of full diameter. Inwardly of that it is relieved as at 19. The relief may extend inwardly and be in varying amounts along the length of the bar as shown at 19.

Bar 14 may extend the entire distance of enclosure 7, or another bar 20 (indicated in dotted outline) may also be placed in bore 13. Bar 14 projects through an opening 21 in end wall 9, and a similar opening may be provided in the opposite end wall for a separate bar 20 or to provide a bearing surface for a single bar 14.

In operation enclosures 2 are moved toward or away from the strip as desired to obtain a proper velocity of steam on the strip 1. The steam effectively spreads and wipes the molten zinc on the strip to produce a uniform distribution. The wiping fluid, the steam jet, tends to distribute the molten zinc avoiding a build up on the edges, for example, and effectively "wiping" the strip even though it is not touched by anything other than the jet. Then as the zinc freezes, it will produce a coating of even thickness. Bar 14 may be arranged to give a variable intensity at various points across the width of the strip. In FIG. 5, for instance, there is substantially greater relief at the outer end of the bar so that more steam will be delivered to the outer edge of the strip. It will be apparent that other bars having different configurations can easily be exchanged to compensate for different or changed conditions. Also rotation of the bar can alter the steam delivery. Since there is a continual variation and almost infinite variety of conditions which can be met, bar 14 is in effect a cam which operates to control the steam flow at an infinite number of points along the length of the orifice.

Over a period there may be different operating conditions which will make a change in steam flow or the distribution of the steam flow necessary or desirable. Bar 14 can readily be withdrawn and another bar of different configuration inserted in its place. If it is desired to run a smaller width of strip through the pot, a different bar having a shorter relieved area may be substituted thereby preventing steam from being jetted into an area where no strip is present. In the same manner one or several bars may be fitted axially into the bore in which the bar 14 is fitted.

While I have illustrated and described certain present preferred embodiments of the invention, it is to be understood that the invention is not limited thereto and may otherwise variously be practiced within the scope of the following claims.

I claim:

1. In an apparatus for wiping liquid from the surface of a moving strip without contacting the strip and including an enclosure in proximity to the pass line of the strip and adapted to receive wiping fluid under pressure and orifice means formed in the enclosure and directed toward the strip, the improvement which comprises elongated valve means adjacent to and behind said orifice and coextending with at least a substantial portion of said orifice means.

2. The apparatus as claimed in claim 1 in which the elongated valve means includes bar means whose shape varies along the length thereof.

3. Apparatus for wiping liquid, molten metal from the surface of moving metallic strip comprising:

an enclosure extending transversely of the strip to be wiped;

fluid supply means to said enclosure adapted for connection to a source of wiping fluid under pressure whereby wiping fluid is delivered inside said enclosure under pressure;

elongated fluid orifice means in said enclosure extending transversely across the strip positioned in proximity to the strip and disposed to direct wiping fluid issuing from the orifice against the strip moving past the enclosure;

fluid valve means within the enclosure disposed between the orifice and the fluid supply means to control passage of wiping fluid through the orifice means, said valve means comprising a rotatable member of irregular cross section placed in close proximity to the orifice and extending substantially parallel to the orifice from end to end of the orifice, incremental sections of the valve means thereby restricting flow through incremental lengths of the orifice, whereby in one position the valve means opens greater area between the fluid supply means and orifice than in another position of the valve means.

4. Apparatus as claimed in claim 3 having valve means extending across at least a substantial width of the strip.

5. Apparatus as claimed in claim 3 in which the valve means include a rotary bar.

6. The apparatus of claim 3 in which the valve means comprises an elongated relieved bar positioned adjacent the orifice, said bar being rotatable to selectively and variably limit flow of wiping fluid from the enclosure through the orifice means.

* * * * *